US008789863B2

(12) United States Patent
Shimizu

(10) Patent No.: US 8,789,863 B2
(45) Date of Patent: Jul. 29, 2014

(54) LOCK APPARATUS

(75) Inventor: Toshihiro Shimizu, Kanagawa (JP)

(73) Assignee: Piolax Inc., Yokohama-Shi, Kanagawa (JP)

( * ) Notice: Subject to any disclaimer, the term of this patent is extended or adjusted under 35 U.S.C. 154(b) by 487 days.

(21) Appl. No.: 13/067,055

(22) Filed: May 4, 2011

(65) Prior Publication Data

US 2011/0309642 A1 Dec. 22, 2011

(30) Foreign Application Priority Data

Jun. 18, 2010 (JP) ..... P. 2010-139764

(51) Int. Cl.
*E05B 3/00* (2006.01)
*E05C 19/00* (2006.01)

(52) U.S. Cl.
USPC ..... 292/336.3; 292/1

(58) Field of Classification Search
USPC ..... 292/1, 336.3
See application file for complete search history.

(56) References Cited

U.S. PATENT DOCUMENTS

| | | | | |
|---|---|---|---|---|
| 3,385,620 | A * | 5/1968 | Porvin | 292/59 |
| 4,283,155 | A * | 8/1981 | Yamazaki et al. | 403/163 |
| 4,762,349 | A * | 8/1988 | Ikeda | 292/216 |
| 5,056,838 | A * | 10/1991 | Tiesler et al. | 292/336.3 |
| 5,092,642 | A * | 3/1992 | Lindmayer et al. | 292/336.3 |
| 5,237,889 | A * | 8/1993 | Conrad | 74/502.4 |
| 5,743,575 | A * | 4/1998 | McFarland | 292/336.3 |
| RE36,694 | E * | 5/2000 | McFarland | 292/336.3 |
| 6,264,257 | B1 * | 7/2001 | Meinke | 292/336.3 |
| 6,264,527 | B1 | 7/2001 | Sabol, Jr. | |
| 6,367,124 | B1 * | 4/2002 | Bella et al. | 292/336.3 |
| 6,460,904 | B1 * | 10/2002 | Stapf | 292/336.3 |
| 6,572,159 | B2 * | 6/2003 | Lambertz et al. | 292/336.3 |
| 6,598,913 | B2 * | 7/2003 | Meinke | 292/336.3 |
| 6,712,409 | B2 * | 3/2004 | Monig | 292/336.3 |
| 6,874,829 | B2 * | 4/2005 | Muller | 292/336.3 |
| 7,216,402 | B2 * | 5/2007 | Nishiyama et al. | 16/412 |
| 7,913,361 | B2 * | 3/2011 | Tomiji | 16/412 |

FOREIGN PATENT DOCUMENTS

| | | |
|---|---|---|
| JP | 60-250184 | 12/1985 |
| JP | 1-92535 | 6/1989 |
| JP | 1-148467 | 10/1989 |
| JP | 05-099291 A | 4/1993 |
| JP | 2009-103270 | 5/2009 |

OTHER PUBLICATIONS

Japanese Notification of Reasons for Refusal dated Sep. 24, 2013 (with English translation).

* cited by examiner

*Primary Examiner* — Carlos Lugo
(74) *Attorney, Agent, or Firm* — McGinn IP Law Group, PLLC

(57) ABSTRACT

According to one embodiment, there is provided a lock apparatus, including: a stationary member; a handle rotatably connected to the stationary member via a handle rotating shaft, the handle having a first member; and a damper having a rotor rotatably connected to the stationary member and a second member fixed to the rotor, wherein the first member and the second member are interlocked with each other through a slit and a projection, the slit being provided in either of the first and second members, the projection being provided on the other of the first and second members so as to loosely fit in the slit.

17 Claims, 4 Drawing Sheets

10

LOCK APPARATUS

CROSS-REFERENCE TO RELATED APPLICATION(S)

This application claims priorities from Japanese Patent Application No. 2010-139764 filed on Jun. 18, 2010, the entire contents of which are incorporated herein by reference.

FIELD

The present invention relates to a lock apparatus which includes a handle and a damper.

BACKGROUND

Generally, an automobile has a glove box covered with a lid. A lock apparatus is attached to the lid of the glove box for locking the lid. For example, such lock apparatus has a handle, and the user can open the lid by operating the handle. When the user releases his or her hand from the handle, the handle returns to its original position. Here, it is not preferable to generate striking noise with the returning movement of the handle returns to the original position.

For example, JP-UM-H01-148467-A discloses a technique for suppressing such striking noise. In this technique, a rack is provided on an arm which extends from a handle, a resistance damper having a gearwheel is provided on a rotating shaft, and the rack is meshed with the gearwheel of the resistance damper, so that resistance torque is generated by the resistance damper in accordance with an operation of the handle.

In JP-UM-H01-148467-A, since the resistance torque is generated through the meshing engagement between the rack and the gearwheel of the resistance damper, vibrations will be generated in accordance with the movement of the handle. Therefore, when the user grips the handle to operate it, the generated vibrations will be transmitted to the user's hand.

SUMMARY

One object of the present invention is to provide a lock apparatus capable of suppressing striking noise of a handle while keeping a smooth operation feeling.

According to an aspect of the present invention, there is provided a lock apparatus, including: a stationary member; a handle rotatably connected to the stationary member via a handle rotating shaft, the handle having a first member; and a damper having a rotor rotatably connected to the stationary member and a second member fixed to the rotor, wherein the first member and the second member are interlocked with each other through a slit and a projection, the slit being provided in either of the first and second members, the projection being provided on the other of the first and second members so as to loosely fit in the slit.

According to the above configuration, the striking noise of the handle can be suppressed while keeping a smooth operation feeling.

DETAILED DESCRIPTION

Figure 1:
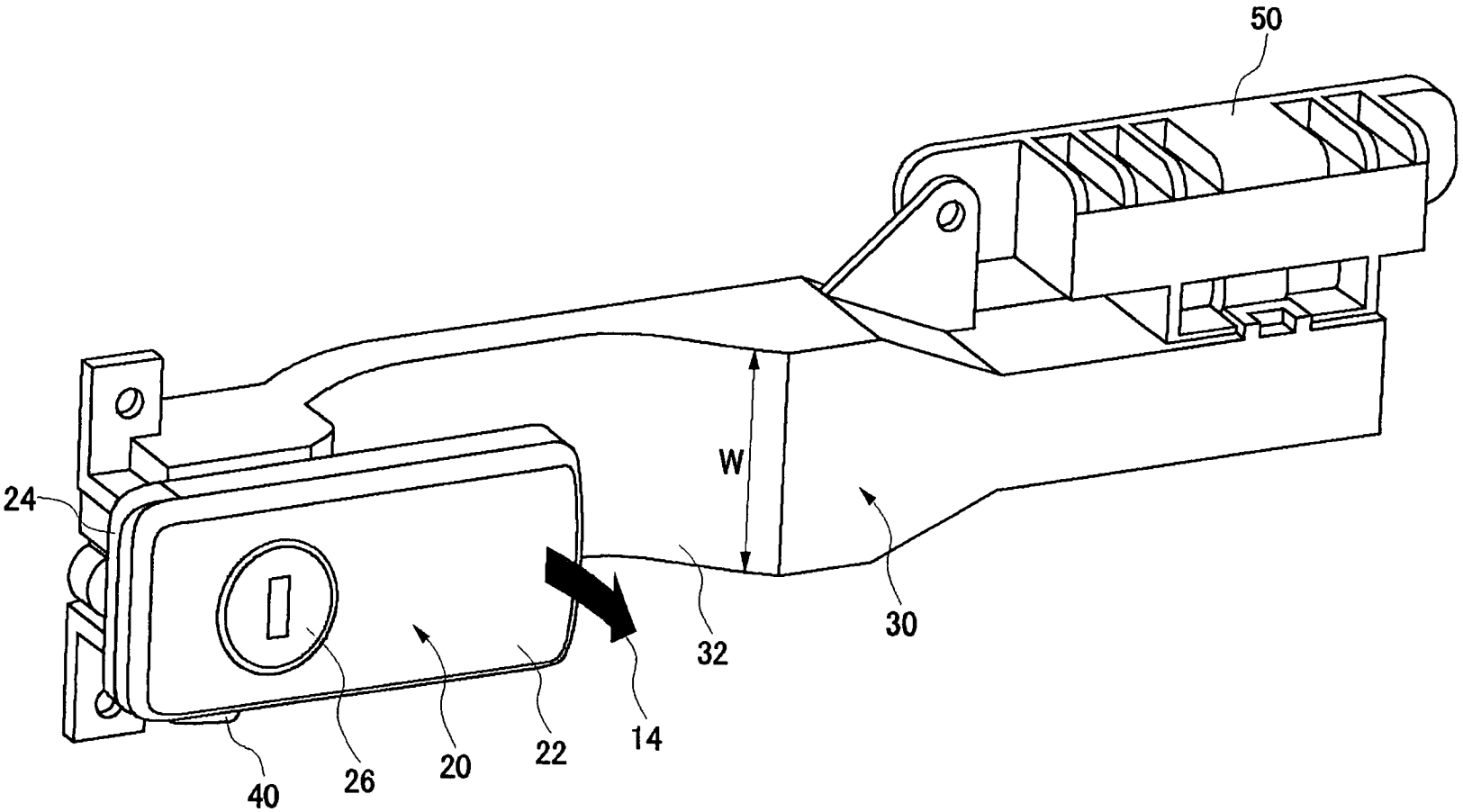
FIG. 1 illustrates a front side of a lock apparatus according to an embodiment.

FIG. 1 illustrates a front side of a lock apparatus 10 according to an embodiment. The lock apparatus 10 is attached to a lid, for example, of a glove box of an automobile, and has a function to lock the lid. The lock apparatus 10 may be formed of a resin material, and includes a handle 20, a stationary member 30, a damper 40 and a lock mechanism 50.

The handle 20 has a top cover 22 and a handle main body 24. The top cover 22 is attached to an outer surface of the handle main body 24 so as to be exposed outward. The damper 40 is to be provided on a side surface of the handle main body 24. A lock portion 26 is embedded inside the handle 20.

As shown in FIG. 1, the stationary member 30 is formed into a rod shape and is attached horizontally to a lid so that the lid vertically openable. The handle 20 is attached to one end portion of the stationary member 30 such that a rotating shaft of the handle 20 is positioned outside, and the lock mechanism 50 is attached to the other end portion of the stationary member 30. The handle 20 and the lock mechanism 50 are connected together by a not-shown connecting member. A portion of the stationary member 30 at a rear side of the handle 20 is formed into a recess portion 32 so that the user can insert the fingers into a space between the handle 20 and the stationary member 30. A vertical width W of the recess portion 32 may be set so that two fingers of the user can be inserted. A vertical width of the handle 20 may also be set similarly.

When the user pulls the handle 20 in a direction indicated by an arrow 14, the rotational operation of the handle 20 is transmitted to the lock mechanism 50 via the not-shown connecting member. Thus, by pulling the handle 20, locking by the lock mechanism 50 is released, and the lid of the glove box opens by its own weight. After the handle 20 has been pulled, the handle 20 returns to its original position by a biasing force of a not-shown elastic member, when the user releases his or her hand from the handle 20. If the handle 20 strongly returns to the original position, striking noise is generated. To suppress such striking noise, the damper 40 is provided in the lock apparatus 10 so as to apply resistance torque in accordance with movement of the handle 20. On a vertically-openable lid, a handle may be dispose to be horizontally opened or to be vertically opened. In the former case (in the embodiment), a rotating shaft of the handle (the handle 20) is provided at right angles with an opening/closing direction of the lid. In the latter case, a rotating shaft of the handle is provided parallel to the opening/closing direction of the lid. Generally, an operation angle of the former-case handle (the handle 20) is set smaller than an operation angle of the latter-case handle. The former-case operation angle is about half the latter-case operation angle. Configurations of the respective components of the lock apparatus 10 will specifically be described.

Figure 2:
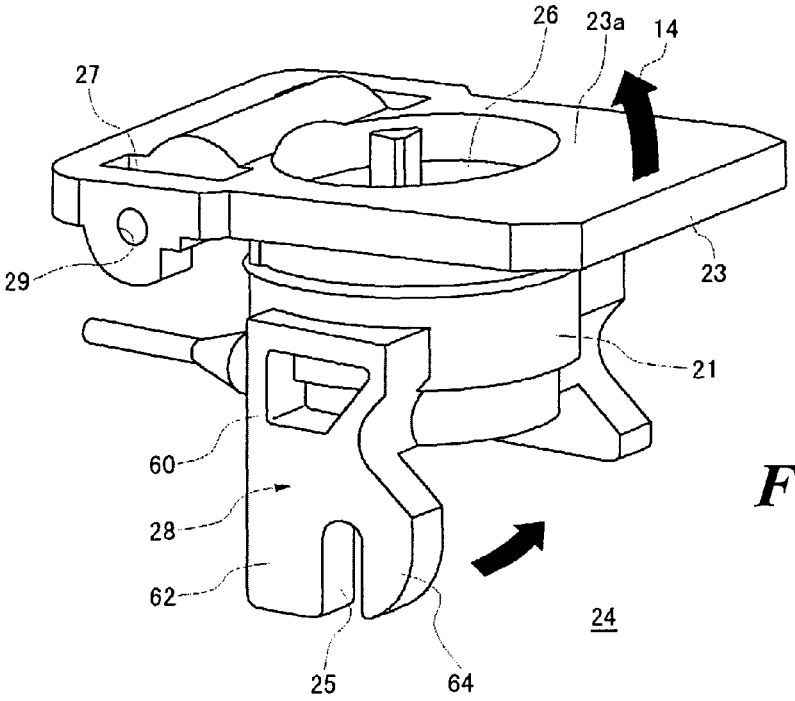
FIG. 2 illustrates a handle main body according to the embodiment.

FIG. 2 illustrates the handle main body 24 according to the embodiment. In the drawings, like reference numerals will be given to similar or like components. And, the repetition of similar descriptions will be omitted. A surface 23*a* of an operation portion 23 is referred to as a front surface, while the not-shown opposite surface is referred to as a rear surface.

The handle main body 24 includes the flat-plate-shaped operation portion 23 to be operated by the user via the top cover 22, a cylindrical accommodation portion 21 accommodating the lock portion 26, and a first member 28 that is a part of an interlocking mechanism. These components are formed integrally with the handle main body 24.

The operation portion 23 is formed into a substantially rectangular shape, and a rotating shaft hole 29 is formed along one side of the operation portion 23. The operation portion 23 is pulled in the direction indicated by the arrow 14 for unlocking the lock. Connecting grooves 27 are provided in the operation portion 23 so as to extend through the rotating shaft hole 29. The accommodation portion 21 is provided to project from a center of the operation portion 23, at the rear surface side.

The first member 28 is fixed to a side surface of the accommodation portion, at the rear surface side of the operation portion 23. The first member 28 may be fixed directly to the operation portion 23. The first member 28 has an extension portion 60, a first projecting portion 62 and a second projecting portion 64. The extension portion 60 extends from the accommodation portion 21, and the first and second projecting portions 62 and 64 further project downwards than a lower surface of the accommodation portion 21. A side surface of the second projecting portion 64 is formed into an arc shape so as to avoid a contact with the stationary member 30 when the handle 20 is rotated with respect to the stationary member 30.

A slit 25 is formed between the first projecting portion 62 and the second projecting portion 64. The slit 25 is a U-shaped cutout opened at one end portion. The slit 25 extends vertically to the operation portion 23. The slit 25 may not be opened, but may be closed at the one end portion. As shown in FIG. 2, when the operation portion 23 rotates in the direction indicated by the arrow 14, the first member 28 moves with the operation portion 23 in an interlocked manner.

Figure 3:
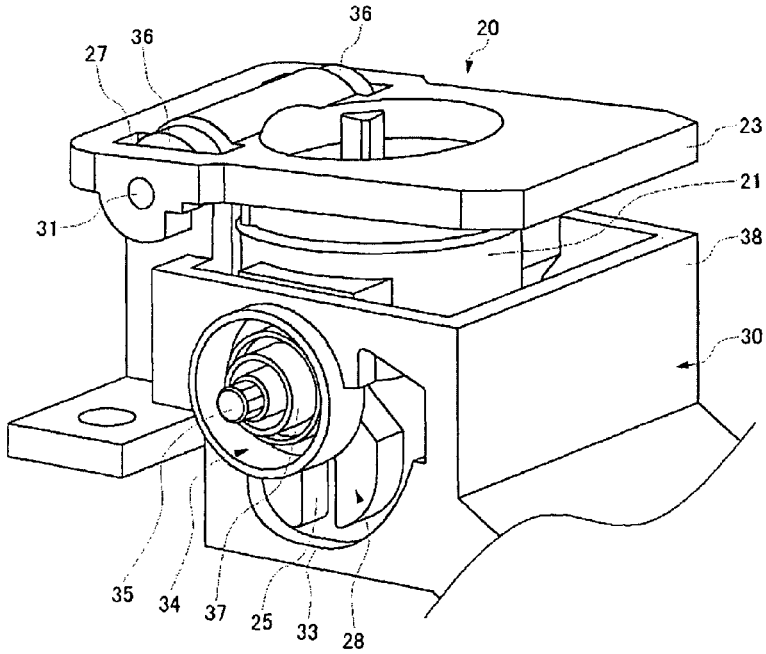
FIG. 3 partially illustrates a stationary member and a handle according to the embodiment.

FIG. 3 partially illustrates the stationary member 30 and the handle 20 in a state where the handle 20 is assembled to the stationary member 30. The stationary member 30 has an accommodation portion 38, shaft connecting portions 36 each having a shaft hole, and a handle rotating shaft 31. These components are all provided at one end of the stationary member 30.

The accommodation portion 38 is formed into a substantially quadrangular cylindrical shape, and accommodates the accommodation portion 21, the first member 28 and a part of a stopper 12 thereinside. From the accommodation portion 21, the two shaft connecting portions 36 project upwards towards the front surface side so as to be respectively inserted into the connecting grooves 27. The handle rotating shaft 31 is inserted into the shaft holes in the shaft connecting portions 36 and the rotating shaft hole 29, so as to rotatably connect the handle 20 and the stationary member 30. The stopper 12 is provided in the accommodation portion 38 so as to restrict the rotation of the handle 20. A portion of the stopper 12 is projected into an inside of the accommodation portion 38 so as to be brought into contact with the handle 20. The rotation of the handle 20 is restricted by an abutment between the accommodation portion 21 and the stopper 12. By forming the stopper 12 with an impact absorbing material, striking noise which is generated by the abutment of the handle 20 and the stopper 12 can be mitigated.

A housing 34 is provided on a side surface of the accommodation portion 38 integrally with the stationary member 30. The housing 34 is formed into a circular cylindrical shape. Inside the housing 34, a damper rotating shaft 35 is provided at a center position, and a housing fitting portion 37 is provided around the damper rotating shaft 35. The housing fitting portion 37 is formed into a circumferential wall to be fitted in the rotor 42 which will be described layer.

An interlocking hole 33 of a substantially arc shape is formed in the side surface of the accommodation portion 38, at a position adjacent to the housing 34. A part of an outer circumference of the housing 34 forms a part of the arc shape of the interlocking hole 33. Although the slit 25 is disposed within the accommodation portion 38, the slit 25 is exposed outward through the interlocking hole 33.

Figure 4:
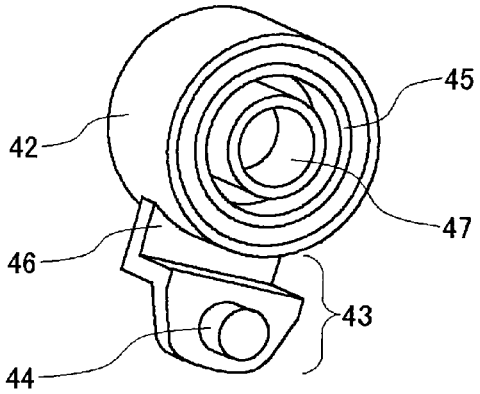
FIG. 4 illustrates a rotor and a second member according to the embodiment.

FIG. 4 illustrates the rotor 42 and a second member 43 according to the embodiment. FIG. 4 shows a side of the rotor 42 to be connected with the housing 34. The rotor 42 is connected rotatably with the housing 34.

The rotor 42 is formed into a cylindrical shape. Inside the rotor 42, a rotating shaft hole 47 is provided at a center position, and a rotor fitting portion 45 is provided around the rotating shaft hole 47. The rotor fitting portion 45 is formed into a circumferential wall to be fitted on the housing fitting portion 37. A damper rotating shaft may be provided in the rotor 42, and the rotating shaft hole may be provided in the housing 34.

The second member 43 is fixed to an outer circumference of the rotor 42. The second member 43 has an arm 46 and a projection 44. The arm 46 extends from the outer circumference of the rotor 42 in a radial direction. The projection 44 projects from the arm 46 in an extending direction of the damper rotating shaft 35.

Figure 5A:
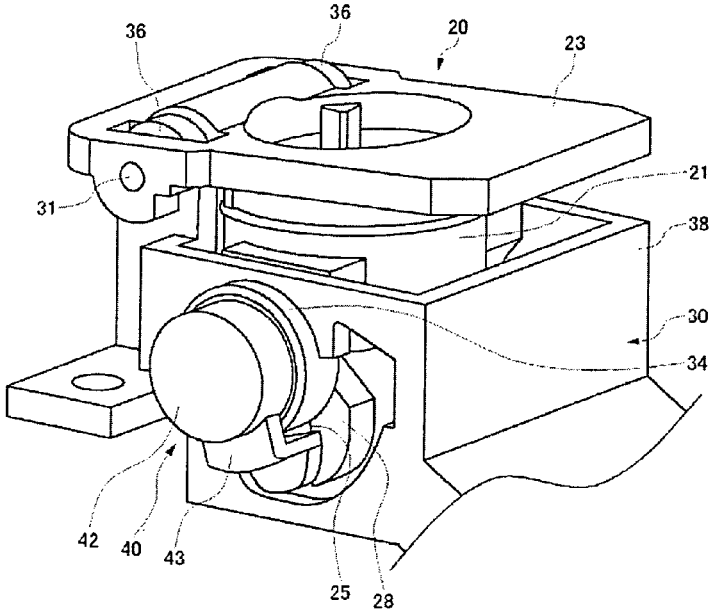
FIGS. 5A and 5B illustrate the handle, the stationary member and a damper according to the embodiment.
Figure 5B:
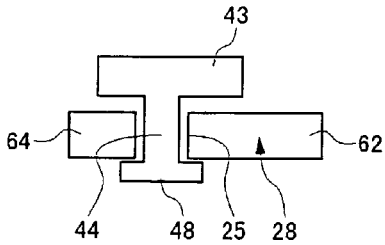

FIG. 5A illustrates the handle 20, the stationary member 30 and the damper 40 according to the embodiment. In FIG. 5A, the damper 40 is further assembled to the state of FIG. 3. FIG. 5B is a sectional view showing the first member 28 and the second member 43 (the projection 44) according to the embodiment.

The rotor 42 is connected to the housing 34 as a part of the damper 40. Between the rotor 42 and the housing 34, a viscous fluid such as grease is filled to generate a resisting force (torque) in accordance with a relative rotation between the rotor 42 and the housing 34. Since the rotor 42 is provided outside the accommodation portion 38, the assemblage of the damper 40 is facilitated, whereby the degree of freedom in designing the handle 20 can be increased.

The projection 44 of the second member 43 is loosely fitted in the slit 25. Thus, an interlocking mechanism between the first member 28 and the second member 43 is formed. A slit may be provided in either of the first member 28 and the second member 43 and a projection may be provided on the other. When the second member 43 moves with the first member 28 in an interlocked manner, the projection 44 moves within the slit 25. By employing the slit 25 in the interlocking mechanism, a smooth operation feeling can be provided as compared with a case where a gearwheel is employed. By providing the slit 25 in the first member and providing the projection 44 on the second member 43, the assemblage of the handle 20 can be facilitated. Further, since the interlocking mechanism and the damper 40 can be formed merely by the three parts of the handle 20, the stationary member 30 and the second member 43, not only the number of parts but also the number of assembling steps can be reduced. Thus, the fabrication costs can be reduced.

As shown in FIG. 5B, an expanded portion 48 may be provided at a projecting end of the projection 44 to have a width larger than the slit 25. By providing the expanded portion 48, the interlocking mechanism can also have a function to prevent the dislodgement of the rotor 42. This configuration facilitates the attachment of the rotor 42, as compared with a case where such dislodgement mechanism is provided inside the rotor 42, for example. Since it is not necessary to provide a dislodgement mechanism in the rotor 42 or in the housing 34, the assemblage of the rotor 42 into the housing 34 is also facilitated. The second member 43 can be assembled into the first member 28 with a simple configuration in which the expanded portion 48 is provided at the projecting end of the projection 44 and the slit 25 is opened.

Figure 6:
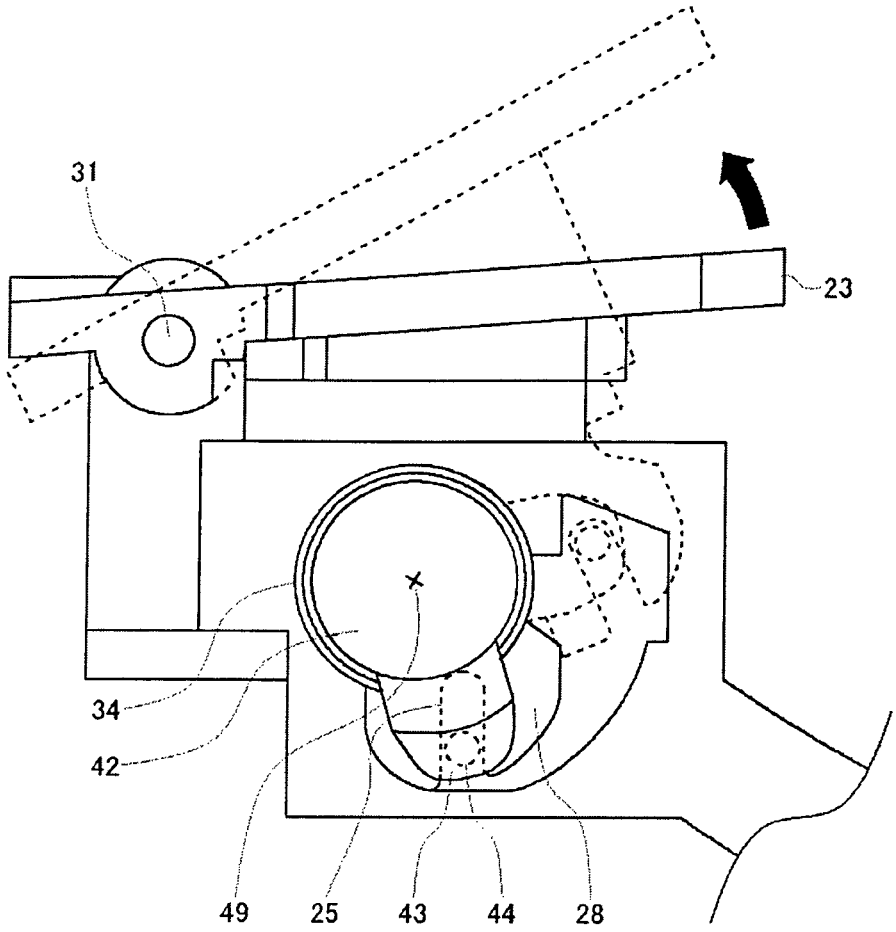
FIG. 6 illustrates the handle, the stationary member and the damper according to the embodiment, from a side.

FIG. 6 illustrates the handle 20, the stationary member 30 and the damper 40 according to the embodiment, from a side. FIG. 6 is a side view of FIG. 5A. In FIG. 6, a state is indicated by dotted lines in which the handle 20 is rotated to its maximum extent. Positions of the slit 25 and the projection 44 are also indicated by dotted lines.

The handle rotating shaft 31 and a rotor rotating shaft 49 are disposed on different axes spaced apart from each other. As a result, the rotor 42 can obtain a larger rotating angle than a rotating angle of the handle 20. Thus, as compared with a case where the damper is provided on a rotating axis of the handle rotating shaft 31, the damper 40 can exhibit a sufficient viscous resistance even for a slight rotation of the handle 20 when it is operated to rotate, thereby effectively suppressing the striking noise of the handle 20.

The rotor rotating shaft 49 is disposed so that it is always positioned closer to the handle rotating shaft 31 as compared with the projection 44. Namely, the rotor rotating shaft 49 is provided in the position where it lies closer to the handle rotating shaft 31 than any positions that the projection 44 can take, and the rotor rotating shaft 49 always lies further radially inwards than the projection 44 about the handle rotating shaft 31. According to the above arrangement, in the stationary member 30, the size of the side surface of the accommodation portion 38 where the damper 40 is provided can be made small, thereby facilitating the assemblage of the lock apparatus 10 to the lid of the glove box.

The invention is not limited to the embodiment, and various modifications such as design changes based on the knowledge of those skilled in the art can be made to the embodiment. The scope of the invention also such includes such modified embodiments.

The invention claimed is:

1. A handle apparatus, comprising:

a stationary member;

a handle rotatably connected to the stationary member via a handle rotating shaft, the handle having a first member; and a damper including:

a rotor, inside which a dampening material is disposed, and rotatably connected to the stationary member; and a second member fixed to the rotor, wherein the first member and the second member are interlocked with each other through a slit and a projection, the slit being provided in either of the first and second members, the projection being provided on the other of the first and second members so as to loosely fit in the slit from an open position of the handle to a closed position of the handle, and wherein the second member extends from the rotor in a radial direction of the rotor and the projection extends from a portion of the second member in an axial direction of the rotor.

2. The apparatus of claim 1, wherein the handle rotating shaft and a rotating shaft of the rotor are disposed on different axes.

3. The apparatus of claim 1, wherein the slit is provided in the first member, and wherein the projection is provided on the second member.

4. The apparatus of claim 1, wherein a rotating shaft of the rotor is disposed so as to be positioned closer to the handle rotating shaft than the projection.

5. The apparatus of claim 1, wherein a rotating shaft of the rotor is disposed so as to be positioned closer to the handle rotating shaft than the projection through an entire operating range of the rotating shaft of the rotor.

6. The apparatus of claim 1, wherein the second member is directly connected to the rotor.

7. The apparatus of claim 1, wherein the slit forms a U-shape.

8. The apparatus of claim 1, wherein the slit is disposed spaced apart, in the axial direction of the rotor, from the portion of the second member from which the projection extends.

9. The apparatus of claim 1, wherein the dampening material comprises a viscous grease.

10. The apparatus of claim 1, wherein the dampener further includes a dampening material disposed inside the rotor.

11. The apparatus of claim 10, wherein the dampening material comprises a viscous grease.

12. The apparatus of claim 1, wherein a rotating axis of the rotating shaft of the rotor is parallel with a rotating axis of the handle rotating shaft.

13. A handle apparatus, comprising:

a stationary member;

a handle rotatable connected to the stationary member via a handle rotating shaft, the handle having a first member; and a damper including:

a rotor, inside which a dampening material is disposed, and rotatably connected to the stationary member; and a second member fixed to the rotor, wherein the first member and the second member are interlocked with each other through a slit and a projection, the slit being provided in either of the first and second members, the projection being provided on the other of the first and second members so as to loosely fit in the slit from an open position of the handle to a closed position of the handle, and wherein an expanded portion is provided at a projecting end of the projection so as to have a width wider than a width of the slit.

14. A handle apparatus, comprising:

a stationary member;

a handle rotatably connected to the stationary member via a handle rotating shaft, the handle having a first member; and a damper including:

a rotor rotatably connected to the stationary member; and a second member fixed to the rotor, wherein the first member and the second member are interlocked with each other through a slit and a projection, the slit being provided in either of the first and second members, the projection being provided on the other of the first and second members so as to loosely fit in the slit, wherein a rotating shaft of the rotor is disposed so as to be positioned closer to the handle rotating shaft than the projection through an entire operating range of the rotating shaft of the rotor, and wherein the second member extends from the rotor in a radial direction of the rotor and the projection extends from a portion of the second member in an axial direction of the rotor.

15. The apparatus of claim 14, wherein the second member is directly connected to the rotor.

16. The apparatus of claim 14, wherein the slit forms a U-shape.

17. The apparatus of claim 14, wherein the slit is disposed spaced apart, in the axial direction of the rotor, from the portion of the second member from which the projection extends.

* * * * *